US005967906A

United States Patent [19]

Horiuchi et al.

[11] Patent Number: 5,967,906

[45] Date of Patent: Oct. 19, 1999

[54] GOLF BALL COATED WITH POLYURETHANE AND/OR EPOXY RESIN PAINT

[75] Inventors: Kuniyasu Horiuchi, Kobe; Yoshikazu Yabuki, Akashi; Kiyoto Maruoka, Kobe, all of Japan

[73] Assignee: Sumitomo Rubber Industries, Ltd., Hgoyo-ken, Japan

[21] Appl. No.: 09/047,470

[22] Filed: Mar. 25, 1998

Related U.S. Application Data

[62] Division of application No. 08/764,256, Dec. 12, 1996, Pat. No. 5,766,097, which is a continuation of application No. 08/365,541, Dec. 28, 1994, abandoned.

[30] Foreign Application Priority Data

Dec. 28, 1993 [JP] Japan ..... 5-353774

[51] Int. Cl.[6] ..... A63B 37/12

[52] U.S. Cl. ..... 473/365; 523/440; 523/443; 524/445; 524/492; 524/590; 473/356

[58] Field of Search ..... 473/356, 365, 473/378; 523/440, 443; 524/445, 492, 590

[56] References Cited

U.S. PATENT DOCUMENTS

| | | | |
|---|---|---|---|
| 4,679,794 | 7/1987 | Yamada et al. . | |
| 4,933,379 | 6/1990 | Scholten et al. | 523/404 |
| 5,029,870 | 7/1991 | Concepcion et al. . | |
| 5,300,325 | 4/1994 | Nealon et al. . | |
| 5,332,792 | 7/1994 | Jablon | 525/539 |

FOREIGN PATENT DOCUMENTS

| | | |
|---|---|---|
| 0419079 | 3/1991 | European Pat. Off. . |
| 562882 | 9/1993 | European Pat. Off. . |
| 2-309980 | 12/1990 | Japan . |

*Primary Examiner*—Robert E. Sellers
*Attorney, Agent, or Firm*—Birch, Stewart, Kolasch & Birch, LLP

[57] ABSTRACT

A golf ball having a dimpled surface is coated with a paint layer having a constant film thickness even at the edges of the dimples wherein the paint layer comprises a polyurethane and/or epoxy resin, and 0.1 to 3% by weight based on the paint resin solids content of silica, clay, calcium carbonate or a mixture thereof optionally surface-treated with a silane coupling agent, silicone oil, fatty acid, organic acid salt or ammonium salt.

7 Claims, No Drawings

GOLF BALL COATED WITH POLYURETHANE AND/OR EPOXY RESIN PAINT

This application is a divisional of application Ser. No. 08/764,256, filed on Dec. 12, 1996, now U.S. Pat. No. 5,766,097 which is a continuation of application Ser. No. 08/365,541, filed on Dec. 28, 1994, now abandoned, the entire contents of which are hereby incorporated by reference.

FIELD OF THE INVENTION

The present invention relates to a coated golf ball, that is, a golf ball of which dimple surface is coated with a paint.

BACKGROUND OF THE INVENTION

In order to maintain appearance clean and to prevent adhesion of stain, a coating of enamel and clear paints or only clear paint is formed on the surface of the golf ball.

Further, concave parts, referred to as "dimple", are formed on the surface of the golf ball and, therefore, constant flying performances and flying distance can be obtained by the dimples.

However, in order to get flying performances of the dimple stably, the coating on the surface of the golf ball must be uniform. On the other hand, since an edge of the dimple on the surface of the golf ball is considerably sharp and, in case of a normal paint, the paint at the edge part flows immediately after coating, thereby reducing the film thickness at the edge part.

In order to improve the above drawback, a trial of increasing the viscosity of the paint has been made. However, when the viscosity of the paint is increased, it becomes difficult to coat the paint. Particularly, the sprayed state where the paint is sprayed from a coating machine is inferior and the smoothness of the surface of the golf ball can not be obtained, which results in inferior appearance.

OBJECTS OF THE INVENTION

The present invention has accomplished in order to improve the above drawback of the golf ball paint. That is, the main object of the present invention is to provide a golf ball having an uniform coating on the surface, particularly a golf ball having an uniform coating even at the edge part of dimples.

This object as well as other objects and advantages of the present invention will become apparent to those skilled in the art from the following description.

SUMMARY OF THE INVENTION

The present invention provides a coated golf ball comprising a golf ball having dimples on a surface which is coated with a paint, wherein said paint is an urethane paint and/or epoxy paint and contains silica, clay, calcium carbonate or a mixture thereof in an amount of 0.1 to 3% by weight based on 100 parts by weight of the paint resin solid content.

DETAILED DESCRIPTION OF THE INVENTION

The golf ball used in the present invention may be any golf balls which have dimples on the surface. Examples of the golf ball include thread-wound golf ball, two-piece golf ball, one-piece golf ball and golf ball having a structure of three pieces or more.

Normally, an urethane paint and/or epoxy paint are applied on the surface of the golf balls. The term "urethane paint" used herein means that the resulting coating is formed of a resin which mainly has an urethane bond, and the term "epoxy paint" used herein means that the resulting coating is formed of a paint which is mainly composed of an epoxy resin. The paint may be a clear paint or an enamel paint containing a pigment.

In the present invention, the paint contains silica, clay, calcium carbonate or a mixture thereof in an amount of 0.1 to 3% by weight based on 100 parts by weight of the paint resin solid content. Examples of the silica filler which is suitably used in the present invention include silicic anhydride and hydrous silicic acid. Examples of the calcium carbonate include ultrafine, active calcium carbonate. Examples of the clay filler include bentonite clay, montmorillonite, colloidal alumina and the like. When inorganic particles such as silica, clay, calcium carbonate, etc. are formulated in the paint, viscosity is not changed at the time of high shear force but the viscosity becomes high at the time of low shear force. When the paint is sprayed through a nozzle at the time of coating of the golf ball, the viscosity is reduced. Then the paint is kept static after coating and no shear force is applied, thus increasing its viscosity. It is considered that the effect of the present invention is obtained by this function. The paint may contains inorganic fillers which have hitherto been used, such as barium sulfate, titanium dioxide, etc., in addition to the above specific inorganic compounds. The particle size of silica, clay and calcium carbonate is not specifically limited, but is preferably 20 $\mu$m or less, more preferably 10 $\mu$m or less.

The above silica, clay and calcium carbonate may be subjected to a surface treatment using silane coupling agent, silicone oil, fatty acid, organic acid salt, ammonium salt and the like. By these particle to the surface treatment, the dispersion properties of some paint can be improved by preventing sedimentation.

When the amount of silica, clay, calcium carbonate or a mixture thereof to be added in the present invention is smaller than 0.1% by weight, the paint flows and the film thickness at the edge part of the dimple becomes thin. On the other hand, when it exceeds 3% by weight, gloss is lost in case of the clear paint and fluidity is drastically decreased and, therefore, the coating will not be uniform.

The paint used for coating the golf ball may contains solvents, curing agents, etc., in addition to the resin as a main material and silica, clay, calcium carbonate or a mixture thereof. The solvent and curing agent may be anyone which has hitherto been used in the coating of the golf ball.

The performances of the paint may be modified by adding silicon leveling agents, surfactants, etc., if necessary.

The surface of the golf ball may be coated with the paint by a normal coating method. In general, coating is conducted using an air gun system, but an electrostatic coating may be conducted.

Normally, the golf ball has a coated layer of 5 to 60 $\mu$m in film thickness. The effect is extremely excellent when the total film thickness becomes 5 to 40 $\mu$m by coating the paint once.

In the present invention, the fluidity at the dimple edge part after paint coating becomes small, thereby obtaining a golf ball of which total surface is coated with an uniform coating. Accordingly, the resulting golf ball is superior in appearance and has a constant and stable depth, size and shape of the dimples. Thereby, the flying performances of the golf ball is stabilized and an excellent golf ball can be obtained. Further, the edge part of the dimple is worn out most severely in the golf ball and a sufficient film thickness can be obtained at the edge part and, therefore, the wear resistance is improved.

EXAMPLES

The following Examples and Comparative Examples further illustrate the present invention in detail but are not to be construed to limit the scope thereof.

Examples 1 to 5 and Comparative Example 1 to 3

A coated golf ball was obtained by coating a paint containing components shown in Table 1 on a normal golf ball according to an electrostatic coating method.

The film thickness of the resulting coated golf ball was measured at three parts, i.e. edge part, land part and bottom of dimple. The results are shown in Table 1. Further, the appearance was visually evaluated and the results are also shown in Table 1.

The "resin content" described in Table 1 means the solid content of those in which base resins, solvents, curing agents, etc. are contained. In Table 1, all "parts" are by weight.

As is apparent from Table 1, Comparative Examples 1 and 2 illustrate the example which does not contain silica, clay, calcium carbonate or a mixture thereof at all or contains it in a small amount. Comparative Example 3 illustrates the example which contains it in a large amount. Regarding those which contain silica, clay, calcium carbonate or a mixture thereof in the small amount, the film thickness at the edge part of the dimple becomes small drastically. On the other hand, regarding those which contain it in the large amount, the predetermined film thickness is maintained but the appearance becomes inferior because of no smoothness. All golf balls of Examples 1 to 5 have an uniform film thickness and the appearance is also excellent.

TABLE 1

(Clear paint)

| | Example No. | | | | | Comparative Example No. | | |
|---|---|---|---|---|---|---|---|---|
| | 1 | 2 | 3 | 4 | 5 | 1 | 2 | 3 |
| Resin content | 100 | 100 | 100 | 100 | 100 | 100 | 100 | 100 |
| Hydrous silicic acid (1) | 0.5 | 2 | — | — | — | — | 0.05 | 5 |
| Silicic anhydride (2) | — | — | 2 | — | — | — | — | — |
| Bentonite clay (3) | — | — | — | 2 | — | — | — | — |
| Ultrafine calcium carbonate (4) | — | — | — | — | 2 | — | — | — |
| Paint film thickness (μm) | | | | | | | | |
| Dimple edge part | 11 | 13 | 13 | 13 | 12 | 6 | 8 | 13 |
| Land part | 14 | 15 | 15 | 15 | 15 | 14 | 14 | 14 |
| Bottom of dimple | 12 | 14 | 14 | 14 | 14 | 12 | 12 | 13 |
| Appearance | Uniform coating, good | Uniform coating, good | Uniform coating, good | Uniform coating, good | Uniform coating, good | Edge part can be seen through the coat, inferior | Edge part can be seen through the coat, inferior | Inferior appearance because of no smoothness and gloss |

(1) Hydrous silicic acid: Nibseal LP commercially available from Nihon Silica Co., Ltd.

(2) Silicic anhydride: Aerozil 300 commercially available from Nihon Aerozil Co., Ltd.

(3) Bentonite clay: Orben commercially available from Shiraishi Kogyo Co., Ltd.

(4) Ultrafine calcium carbonate: White seal W-KK commercially available from Takehara Kagaku Kogyo Co., Ltd.

Examples 6 to 10 and Comparative Examples 4 to 5

According to the same manner as that described in Example 1 except for using a paint of the formulation shown in Table 2, the evaluation was conducted. The results are shown in Table 2. Further, an enamel paint was used in these Examples and Comparative Examples.

TABLE 2

(Enamel paint)

| | Example No. | | | | | Comparative Example No. | | |
|---|---|---|---|---|---|---|---|---|
| | 6 | 7 | 8 | 9 | 10 | 4 | 5 | 6 |
| Resin content | 100 | 100 | 100 | 100 | 100 | 100 | 100 | 100 |
| Titanium oxide | 100 | 100 | 100 | 100 | 100 | — | 100 | 100 |
| Hydous silicic acid (1) | 0.5 | 2 | — | — | — | — | 0.1 | 5 |
| Silicic anhydride (2) | — | — | 2 | — | — | — | — | — |
| Bentonite clay (3) | — | — | — | 2 | — | — | — | — |
| Ultrafine calcium carbonate (4) | — | — | — | — | 2 | — | — | — |
| Paint film thickness ($\mu$m) | | | | | | | | |
| Dimple edge part | 25 | 27 | 27 | 26 | 26 | 15 | 18 | 27 |
| Land part | 29 | 29 | 29 | 29 | 29 | 29 | 29 | 32 |
| Bottom of dimple | 28 | 28 | 28 | 28 | 28 | 27 | 27 | 24 |
| Appearance | Uniform coating, good | Uniform coating, good | Uniform coating, good | Uniform coating, good | Uniform coating, good | Edge part can be seen through the coat, inferior | Edge part can be seen through the coat, inferior | Film thickness is thin at the bottom of dimple, ununiform coating |

As is apparent from Table 2, regarding the example wherein silica, clay, calcium carbonate or a mixture thereof is not used at all or used it in a small amount, the film thickness at the dimple edge part is small and the edge part can be seen through the coating. On the other hand, when the amount of silica, clay, calcium carbonate or a mixture thereof is large as shown in Comparative Example 6, the film thickness of the paint is sufficient, but the film thickness is small at the bottom of the dimple, which results in ununiform coating.

However, those of the present invention have uniform film thickness and are also superior in appearance.

What is claimed is:

1. A coated golf ball comprising a golf ball having a dimpled surface and a paint layer on said dimpled surface, said paint layer having a thickness of from 5 to 40 $\mu$m comprising 1) a polyurethane, an epoxy resin or a mixture thereof and 2) from 0.1 to 3% by weight based on the paint resin solids content of particles of silicic anhydride, hydrous silicic acid, calcium carbonate or a mixture thereof surface treated with a silane coupling agent, silicone oil, fatty acid, organic acid salt or ammonium salt and having a particle size of 20 $\mu$m or less.

2. The coated golf ball according to claim 1 wherein the golf ball comprises a thread-wound golf ball, a one-piece golf ball, a two-piece golf ball or a golf ball having a structure of three pieces or more.

3. The coated golf ball according to claim 1 wherein said particles have a particle size of 1 $\mu$m or less.

4. The coated golf ball according to claim 1 wherein said particles are silicic anhydride particles.

5. The coated golf ball according to claim 1 wherein said particles are hydrous silicic acid particles.

6. The coated golf ball according to claim 1 wherein said particles are calcium carbonate particles.

7. The coated golf ball according to claim 1 wherein the paint layer has a thickness of from 11 to 40 $\mu$m.

* * * * *